US006148875A

United States Patent [19]

Breen

[11] Patent Number: 6,148,875

[45] Date of Patent: Nov. 21, 2000

[54] VACUUM FOOD STORAGE SYSTEM

[76] Inventor: James Breen, 31 Park Trail, Croton, N.Y. 10520

[21] Appl. No.: 08/878,373

[22] Filed: Jun. 18, 1997

[51] Int. Cl.[7] ..... B65B 1/04

[52] U.S. Cl. ..... 141/65; 141/98; 141/192; 220/231

[58] Field of Search ..... 141/65, 98, 82, 141/192, 198; 220/231

[56] References Cited

U.S. PATENT DOCUMENTS

| | | | |
|---|---|---|---|
| 2,294,530 | 9/1942 | Wiese . | |
| 3,048,928 | 8/1962 | Copson et al. . | |
| 3,311,991 | 4/1967 | Gidlow . | |
| 3,950,963 | 4/1976 | Sutherland | 62/268 |
| 4,020,563 | 5/1977 | Hoefer | 34/48 |
| 4,597,188 | 7/1986 | Trappler | 34/5 |
| 5,201,348 | 4/1993 | Lurz | 141/65 |
| 5,405,038 | 4/1995 | Chuang | 141/65 |
| 5,765,608 | 6/1998 | Kristen | 141/65 |

*Primary Examiner*—Steven O. Douglas
*Attorney, Agent, or Firm*—Milde, Hoffberg & Macklin, LLP

[57] ABSTRACT

A vacuum food storage system comprising:

(a) a storage container open at its top or front and suitable for containing fruit, vegetables or cold cuts;

(b) a lid to cover the open top or front of the storage container and having an air-tight gasket surrounding its perimeter adjoining the open top or front of the storage container;

(c) an electrical vacuum pump for evacuating the air from the storage container to a preset pressure when fruit, vegetables or cold cuts are placed in the storage container and the lid is securely seated on the open top or front of the storage container; and (d) mechanism for releasing the vacuum when it is desired to remove fruit, vegetables or cold cuts from the storage container.

14 Claims, 4 Drawing Sheets

VACUUM FOOD STORAGE SYSTEM

BACKGROUND OF THE INVENTION

The present invention relates to a novel vacuum food storage system for maintaining refrigerated food, e.g., fruits and vegetables, cheese, bread, cold cuts and meat, fresh for periods longer than possible with conventional refrigerator storage systems. The novel vacuum food storage systems are also useful for preserving freshness and minimizing or eliminating "freezer burn" in frozen foods in the freezer. In addition, the novel vacuum food storage systems may be used to maintain freshness while transporting foods.

SUMMARY OF THE INVENTION

It is an object of the present invention to provide a vacuum food storage system that maintains food fresher longer in a refrigerator or freezer than is possible with current storage systems.

It is an object of the present invention to provide a vacuum food storage system that may be retrofitted in a refrigerator or freezer to provide superior long-lasting freshness to food stored therein.

It is another object of the present invention to provide a vacuum food storage system that may be built into a refrigerator or freezer to provide superior long-lasting freshness to food stored therein.

It is another object of the present invention to provide a vacuum food storage system that may be self-contained.

Yet another object of this invention is to provide a vacuum food storage system that may be used to transport the vegetables and fruit from the growing field to the consumer at the supermarket.

These objects, as well as further objects which will become apparent from the discussion that follows, are achieved, in accordance with the present invention, by a vacuum food storage system comprising:

(a) a storage container open at its top or front and suitable for containing fruit, vegetables, meat or cold cuts;

(b) a lid to cover the open top or front of the storage container and having an air-tight gasket surrounding its perimeter adjoining the open top or front of the storage container;

(c) means for evacuating the air from the storage container to a preset pressure when fruit, vegetables, meat or cold cuts are placed in the storage container and the lid is securely seated on the open top or front of the storage container; and (d) means for releasing the vacuum when it is desired to remove fruit, vegetables, meat or cold cuts from the evacuated storage container.

PREFERRED EMBODIMENTS OF THE INVENTION

The vacuum food storage system of the invention is preferably a storage container in a residential or commercial refrigerator. The lid or door has an air-tight self-sealing gasket around the opening of the container that it adjoins. A vacuum is pulled when the lid or door is closed, making the container an air-tight vacuum container. Preferably, a pump automatically goes on when the lid is closed and removes air from the container. The pump stops when the air pressure gauge reaches the preset degree of vacuum. The pump may be automatically started and stopped by means of the air pressure gauge in order to maintain the preset degree of vacuum. The pump does not operate, however, with the lid open.

Figure 1:
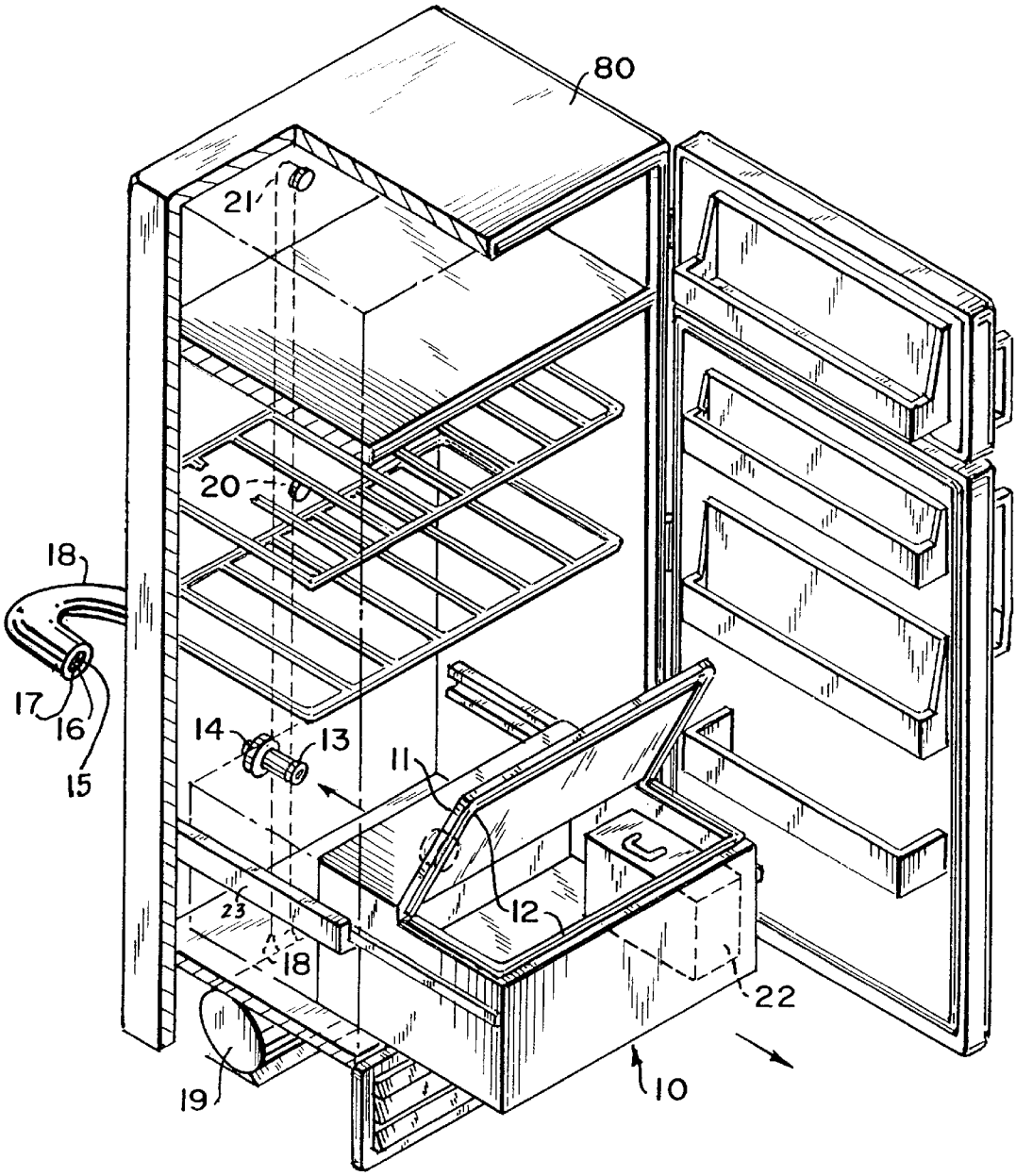
FIG. 1 is a perspective view of the vacuum food storage system of the invention (with its lid open) as it would be factory-fitted into a refrigerator.

FIG. 1 shows a perspective view of the vacuum food storage system of the invention as it would be factory-fitted into a refrigerator 80 (shown partly cut away), in which storage container 10, which is suitable for storing fruits and vegetables, is covered by lid 11, which is shown open and hinged at its rear edge for convenience. The lid 11 may, however, be a separate unconnected element. Rubber gaskets 12 are shown on the top edge of container 10 and around the perimeter of the bottom surface of the lid 11. When the lid 11 is closed, vacuum may be applied to the container by means of vacuum T-connection 13, which contains a baffle vacuum seal 14 and communicates with the interior of container 10 and with the vacuum hose 15. Vacuum hose 15 together with wiring for switches 16 and a water hose 17 for the automatic filling of the moisture control unit are incorporated into a harness 18. The harness 18 carries the vacuum line from the vacuum pump 19 to the vacuum T-connection 13, then to the vacuum T-connection 20 for a separate storage bin (not shown) and finally to the freezer connection 21 for a separate freezer compartment. Also shown in FIG. 1 is a permanent moisture control unit 22, which is part of the storage container 10. The storage container 10 may be slid in and out of the refrigerator on tracks 23 mounted on the refrigerator walls on either side of the storage container 10.

Figure 1B:
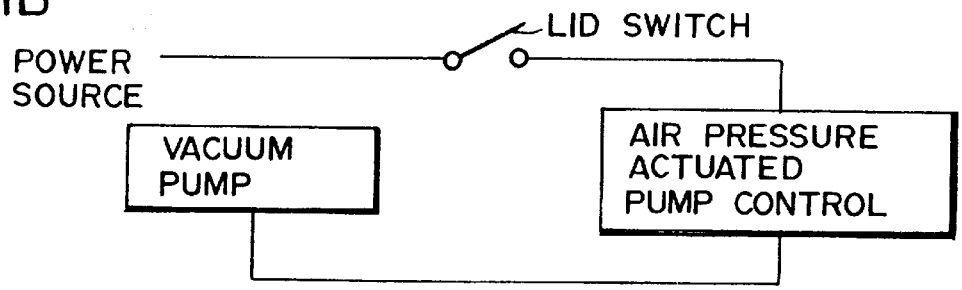
FIG. 1B illustrates a block circuit diagram for the food storage system of the invention.
Figure 1A:
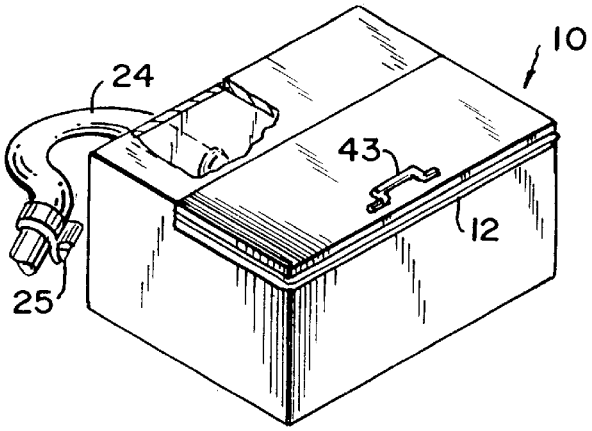
FIG. 1A is a perspective view of the vacuum food storage system of FIG. 1 shown with its lid closed.

FIG. 1A is a perspective view of the vacuum food storage system of FIG. 1 shown with its lid closed. Storage container 10 is shown removed from the refrigerator 80 and shown connected to an alternative flexible harness 24, which is shown with spring clip 25, which allows the storage container 10 to be slid in and out of the refrigerator without disconnecting the vacuum connection. Access to the food in the partly air-evacuated storage container 10 may be gained by means of vacuum release lid handle 43.

FIG. 1B is a block circuit diagram for the food storage system of the invention. Power is supplied by conventional means. If the lid 11 of storage container 10 is opened, the lid switch is opened thereby breaking the circuit. When the lid 11 is closed, the lid switch is thereby closed and the air pressure actuated pump control starts the vacuum pump and power is supplied to the vacuum pump until the preset degree of vacuum is reached, whereupon the air pressure actuated pump control shuts off the vacuum pump and allows the baffle vacuum seal to maintain the vacuum in the storage container 10. A vacuum release means 43 is provided for use when opening of the container is required in order to remove some food from its interior.

FIG. 1C is a perspective view of a cylindrical variation of the food storage system depicted in FIG. 1A. Storage container 70 is covered by lid 71. Gasket 72 is disposed between container 70 and lid 71. Container 70 is connected to flexible harness 74, which is shown with spring clip 75. Access to the food in the partly air-evacuated storage container 70 may be gained by means of vacuum release lid handle 73.

Figure 2:
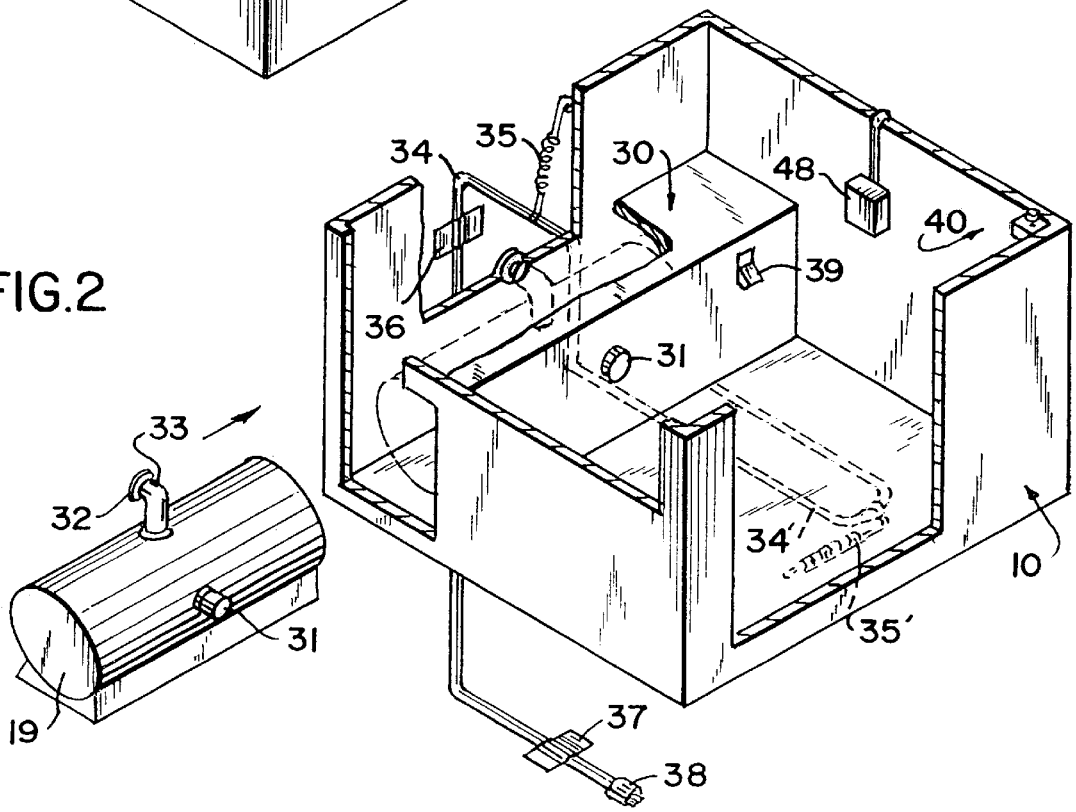
FIG. 2 is a perspective view of a self-contained food storage system of the invention.

FIG. 2 is a perspective view of a self-contained food storage system of the invention, suitable for retrofitting in a refrigerator, in which vacuum pump 19 is located in housing 30, which in turn is located inside food storage container 90. When the vacuum pump 19 is in operation, air from the closed container 90 is drawn through intake valve 31 into the vacuum pump 19 and is exhausted through vacuum seal baffle 32 to exhaust 33. Power cord 34 at the back of container 90 is retractably held in place by spring clip 35. (In an alternative configuration, the power cord 34' may be mounted on the bottom of the container 90, in which case spring clip 35' allows the power cord to be extended and retracted as container 90 is slid out and in.) The power cord 34 may be secured to the inside wall of the refrigerator with tape 36 to maintain it in position. A foam rubber strip with adhesive tape backing 37 may be used where the power cord 34 exits between the refrigerator cabinet and the refrigerator door in order to maintain the cold seal. Power cord 34 is terminated with a plug 38. Air pressure actuated vacuum pump switch 39 is located inside the container 90. Lid switch 40 is opened when the lid is opened and closed when the lid is closed. Together the air pressure actuated vacuum pump switch 39 and the lid switch 40 control the operation of the vacuum pump as described above concerning FIG. 1B. Clip-on moisture control unit 48 is mounted to the inside of container 90 and supplies humidity to the produce stored in the container 90 in order to prevent the produce from drying out.

Figure 2A:
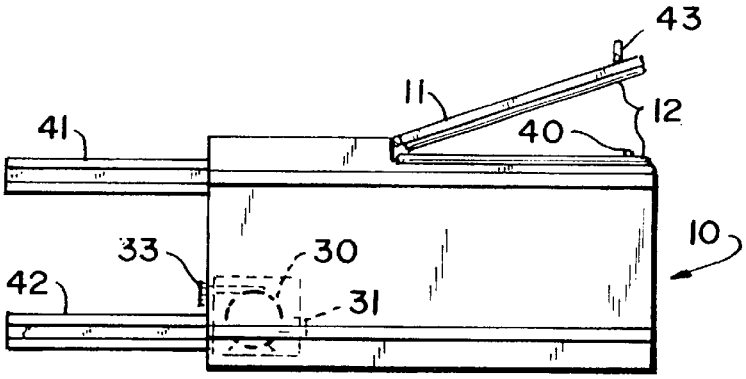
FIG. 2A is a side view of a top-opening version of the system illustrated in FIG. 2.

FIG. 2A is a side view of a top-opening version of the system illustrated in FIG. 2. Depicted is container 100, which contains vacuum pump housing 30, including intake valve 31 and exhaust 33. Universal track 41 allows for use in different models of refrigerators. Bottom track 42 allows for bottom glide installation. Access to the food in the partly air-evacuated storage container 100 may be gained by means of vacuum release lid handle 43. Lid Rubber gaskets 12 are shown on the top edge of container 100 and around the perimeter of the bottom surface of the lid 11. Lid switch 40 is opened when the lid is opened and closed when the lid is closed.

Figure 2B:
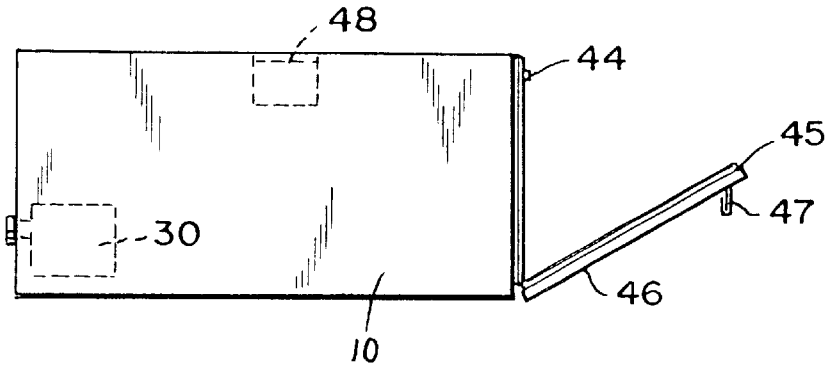
FIG. 2B is a side view of an alternative front-opening system illustrated in FIG. 2.

FIG. 2B is a side view of an alternative front-opening version of the system illustrated in FIG. 2. Container 110 contains vacuum pump housing 30. Front load door switch 44 functions in the same manner as the lid switch 40. Gasket 45 is attached around the inside perimeter of the door 46. Access to the food in a partly air-evacuated storage container 110 may be gained by means of vacuum release door handle 47. Also shown is optional clip-on moisture unit 48, which, when filled with water, is capable of adding humidity to the atmosphere surrounding food in the at least partly evacuated container 110.

Figure 3:
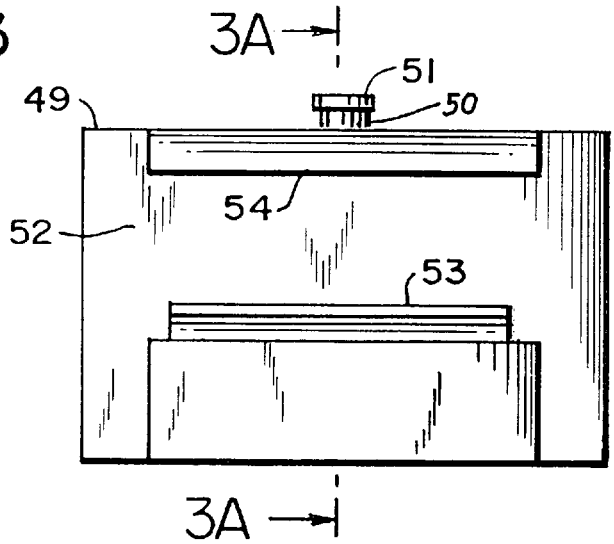
FIG. 3 is a perspective view of a moisture control unit for the food storage system of the invention.

FIG. 3 is a front perspective view of a moisture control unit 48 for the food storage system of the invention. Water may be poured into the moisture control unit 48 through fill spout 50, which then may be covered by cap 51. Water in the moisture control unit 48 wets sponge or semipermeable membrane 52, the exposure of which to the atmosphere inside the container 10 is controlled by movable shutter 53. Drip lip 54 is on the top edge of shutter 53 and serves to prevent liquid water from dripping into the food storage container from the wet sponge or semipermeable membrane 52.

Figure 3A:
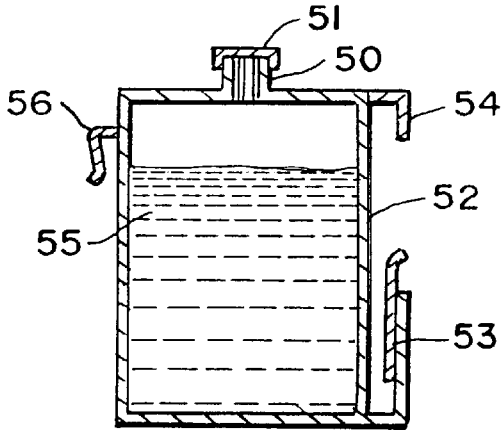
FIG. 3A is a side view of the unit illustrated in FIG. 3.

FIG. 3A is a side view of the unit illustrated in FIG. 3, which shows fill spout 50, cap 51 and water 55. Exposure of sponge or semipermeable membrane 52 to the atmosphere inside the container 10 is again controlled by moveable shutter 53. Clip 56 is used to mount the unit inside the container 10.

Figure 4:
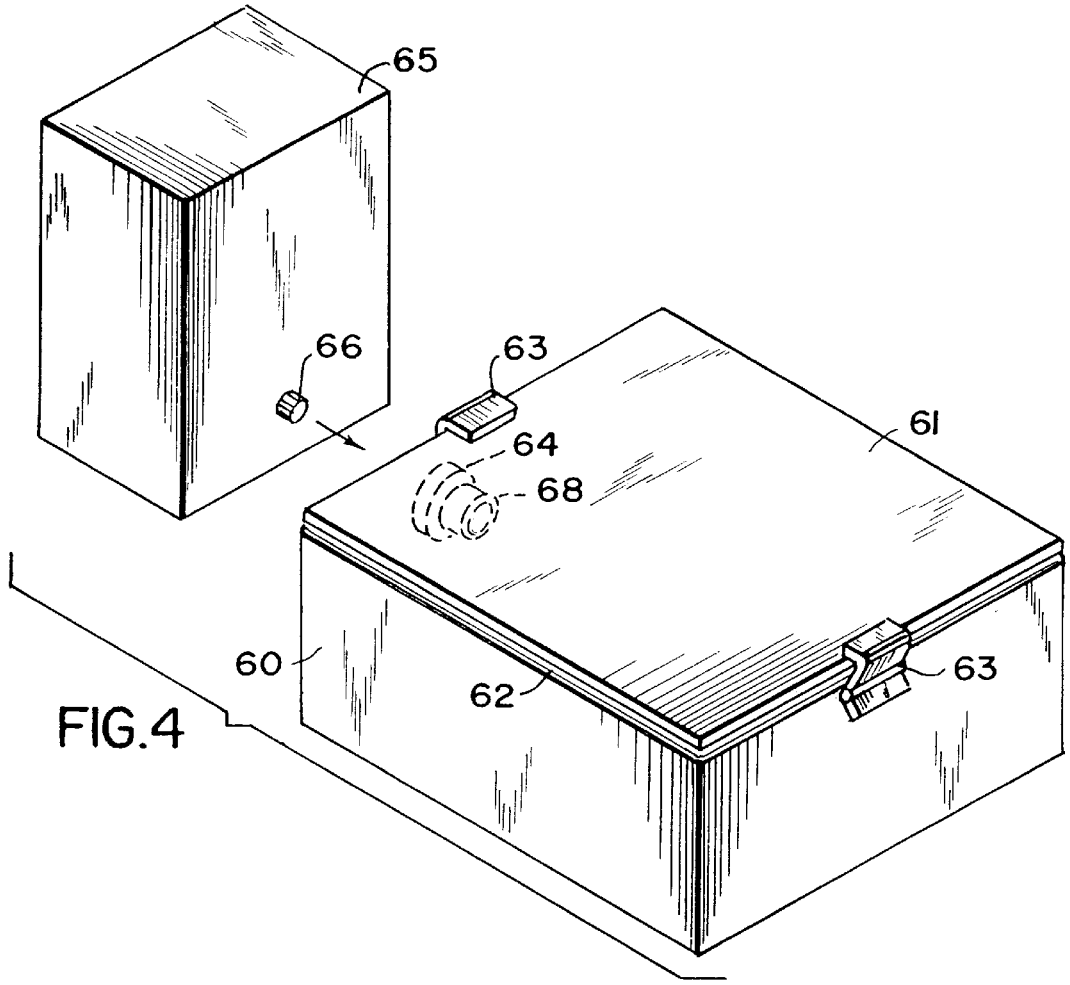
FIG. 4 is a side view shown partly in perspective of a PERMA FRESH™ food storage system of the invention.

FIG. 4 is a perspective view of a PERMA FRESH™ food storage system of the invention, in which shipping bin 60 has a lid 61 with gasket 62. The lid 61 is secured by clips 63 in order to maintain the seal during shipping. A female connector 64 having a baffle seal 68 is connected to a portable vacuum pump 65 via a male connector 66 for field use. After evacuation, the shipping bin 60 may be disconnected and stored or shipped to market.

Figure 4A:
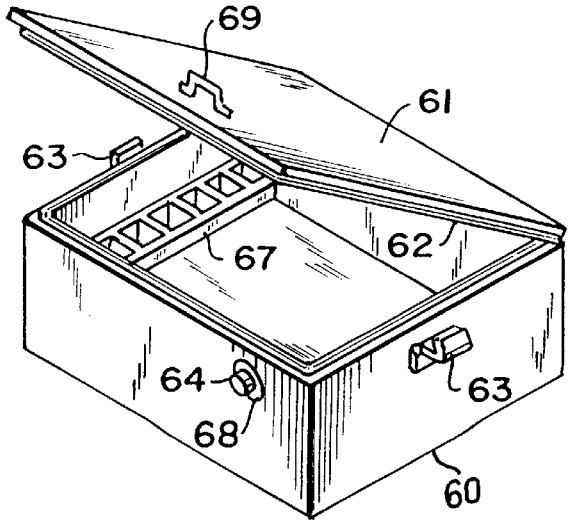
FIG. 4A is a perspective view of the system illustrated in FIG. 4.

FIG. 4A is a perspective view of the shipping, vacuum storage and display system 60 illustrated in FIG. 4, in which bin 60 has a clear plastic hinged lid 61 fitted to the bin 60 with an air-tight gasket seal 62. Internal removable shelves may be inserted at position 67. Removable clips 63 secure the lid 61 to the bin 60 in order to maintain the vacuum seal during transport. In a PERMA FRESH™ Store Display system of the invention, a female connector 64 having a baffle seal 68 may be connected either to a portable or stationary vacuum pump 65 via a male connector 66 for maintaining the vacuum that was pulled on the system after field packing of the produce. When a store employee or a customer wishes to obtain an item in the display bin, he or she merely has to lift vacuum release lid handle 69.

Food stored in the vacuum food storage system of the invention will stay fresh for weeks longer than food placed in regular refrigerator compartments.

In the vacuum means for the vacuum food storage systems of the invention, several kinds of pumps may be used, e.g, a separate pump, or an existing pump may be adapted, e.g., a refrigerator compressor motor, to run a vacuum pump. The existing pump may be of the piston or rotary type to double as a vacuum pump.

In one embodiment of the invention, the system may a factory fitted unit, preferably with the vacuum pump run by the same motor that runs the compressor for the refrigeration system of the refrigerator.

The degree of vacuum may be preset to any desired level that may achieved by the vacuum means employed. Factors to be considered in setting the degree of vacuum, or conversely the pressure in the system, are the shape of the container, including any reinforcing ribs, and the strength of the material from which it is constructed as well as the thickness of the material. These factors set a practical limit on the maximum degree of vacuum that can be achieved in some systems without the atmospheric pressure causing the container to collapse. Generally, the higher the degree of vacuum, the less the amount of oxygen in the atmosphere within the enclosed container and consequently the longer the freshness of the food can be maintained. Preferably, the atmospheric pressure inside the enclosed container should be reduced by at least about 10 percent. The practical lower limit to the pressure in the container is the partial pressure of water vapor at the temperature of the food stored in the closed container.

Commercially available switches and vacuum gauges can be used.

A flexible harness comprising hoses for the vacuum line and wiring for switches can be hooked to a Y connector to supply 2 or more separate storage containers for produce and cold cuts.

In addition to top opening containers, front opening containers of the invention are also useful. The containers may be stationary, or they may slide out of the refrigerator or freezer. They may be placed in the bottom of the refrigerator for produce, in the middle of the refrigerator for cold cuts, meats etc., and in the freezer compartment for frozen foods.

In another embodiment, the systems of the invention may be retrofitted units, e.g., they may be installed as a kit in a manner similar to the way refrigerator ice makers are installed.

In the retrofitted embodiment, possible pumps include separate small rotary or piston pumps as a part of the container, or the pumps may be mounted outside the refrigerated area.

Installation of a retrofitted unit may require drilling of a hole in the back of the refrigerator for the hose and wiring harness for the pump.

Adaptation of a refrigerator shelf is possible to accommodate a slide out version of the system of the invention. It is possible to have a separate slide mechanism so that the unit can be either fixed or slide when the separate slide mechanism is attached to the system unit.

If the moisture in the vacuum food storage system of the invention is reduced too much by the application of vacuum, the food may dry out or wilt. Consequently, it may be advisable in such a case to provide a means for adding humidity to the vacuum food storage systems of the invention. Water vapor may be added by means of a sponge soaked with water being placed in the container or by a water misting means.

The means for providing humidity may be a baffle type humidifier in which a chamber in the container has a baffle which opens when the pump is on. In the chamber is a sponge that is saturated with water.

The vacuum food storage system of the invention may be self-contained with a vacuum pump as part of the container. No installation is required to use such a self-contained system in a refrigerator. It is possible to have an electrical receptacle inside the refrigerator to accept the electrical plug from the vacuum pump. Alternatively, the electrical cord from the vacuum pump may be run between the gasketed door of the refrigerator and the cabinet of the refrigerator and from there to an electical outlet into which the plug from the vacuum pump may be inserted. Tape and foam rubber may be used as a cushion for the electric cord to pass between the door and the refigerator cabinet without loss of cold in the refrigerator. This is also more aesthetic. Again, it is possible to have the container open from the front or from the top. A slide out configuration is also possible.

A self-contained unit may be used outside of a refrigerator to store bread.

In a versatile configuration, the gliders for the slide tracks may be a separate component that may attached to the container in order to accommodate some uses that require them and yet be removable for those uses that do not require them.

When mounted in a refrigerator, the system may be incorporated in a slide out top track configuration with the track mounted to the underside of a refrigerator shelf, and the top of the container glides on the track. Alternatively, the system may be incorporated in a slide out bottom track configuration with the track mounted to the bottom of the refrigerator or top of a shelf (where it can be secured) and the bottom of the container fits into the track and glides on the track. The slide out bottom track configuration is suitable for retrofitting.

Custom made vacuum food storage containers can be used for shipping of farm fresh produce, herbs and fruit to distributers. A portable vacuum food transportation unit can be used to vacuum seal the containers before they are loaded into refrigerator cars or trucks.

Vacuum food storage systems of the invention with clear plastic lids can be used to ship, store and then display produce in supermarkets. The units may be plugged into an existing vacuum system in a supermarket. Also, by combining the shipping, storage and display unit, handling of the produce is minimized.

The foregoing specification and drawings have thus described and illustrated a novel vacuum food storage system for maintaining food fresh longer, which fulfills all the objects and advantages sought therefor. Many changes, modifications, variations and other uses and applications of the subject invention will, however, become apparent to those skilled in the art after considering this specification which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. A vacuum food storage system comprising:

(a) a storage container open at its top or front and suitable for containing fruit, vegetables or cold cuts;

(b) a lid to cover either the open top or front respectively of the storage container and having an air-tight gasket surrounding its perimeter adjoining the open top or front of the storage container;

(c) an electrical vacuum pump for evacuating air from the storage container to a preset pressure when fruit, vegetables or cold cuts are placed in the storage container and the lid is securely seated on the open top or front of the storage container; and (d) means attached to the storage container for releasing the vacuum when it is desired to remove fruit, vegetables or cold cuts from the storage container.

2. The vacuum food storage system as claimed in claim 1, wherein the storage container and the lid are made of plastic or metal.

3. The vacuum food storage system as claimed in claim 1, wherein the lid is made of clear plastic.

4. The vacuum food storage system as claimed in claim 1, wherein the gasket is made from natural or synthetic rubber.

5. The vacuum food storage system as claimed in claim 1, wherein the container is a rectangular prism in shape.

6. The vacuum food storage system as claimed in claim 1, wherein the vacuum pump is integrated with the food storage container.

7. The vacuum food storage system as claimed in claim 1, wherein the vacuum pump is integrated with a refrigerator or freezer.

8. The vacuum food storage system as claimed in claim 1, wherein there is a pressure sensing means that communicates with the evacuated storage container.

9. The vacuum food storage system as claimed in claim 8, wherein the pressure sensing means automatically turns on the vacuum means when the pressure within the storage container is above a preset limit, but does not turn on the vacuum means when the lid is open.

10. The vacuum food storage system as claimed in claim 1, wherein there is present in the container a means of adding humidity to the system.

11. The vacuum food storage system as claimed in claim 1, wherein there is a vacuum seal baffle that prevents air from rushing into the evacuated system when the vacuum means is not in operation.

12. The vacuum food storage system as claimed in claim 1, wherein the system is placed in a refrigerator or freezer.

13. The vacuum food storage system as claimed in claim 1, wherein the atmospheric pressure in the system is reduced by at least about 10 percent.

14. A vacuum food storage system comprising:

(a) a storage container open at its top or front and suitable for containing fruit, vegetables or cold cuts;

(b) a lid to cover the open top or front of the storage container and having an air-tight gasket surrounding its perimeter adjoining the open top or front of the storage container;

(c) means for evacuating air from the storage container to a preset pressure when fruit, vegetables or cold cuts are placed in the storage container and the lid is securely seated on the open top or front of the storage container;

(d) means for releasing the vacuum when it is desired to remove fruit, vegetables or cold cuts from the storage container; and (e) pressure sensing means that communicates with the evacuated storage container and that automatically turns on the vacuum means when the pressure within the storage container is above a preset limit, but does not turn on the vacuum means when the lid is open.

* * * * *